US006216865B1

(12) United States Patent
Maeng

(10) Patent No.: US 6,216,865 B1
(45) Date of Patent: Apr. 17, 2001

(54) GOLF BAG WITH CLUB SEPARATORS

(76) Inventor: Seop Maeng, 903-7 Gorim-R1 Yongin-EUP, Yonging-Kun Kyungkido, Seoul (KR)

( * ) Notice: Subject to any disclaimer, the term of this patent is extended or adjusted under 35 U.S.C. 154(b) by 0 days.

(21) Appl. No.: 09/390,790

(22) Filed: Sep. 7, 1999

(30) Foreign Application Priority Data

Sep. 4, 1998 (KR) ..... 98-16790

(51) Int. Cl.[7] ..... A63B 55/00
(52) U.S. Cl. ..... 206/315.6; 206/315.3
(58) Field of Search ..... 206/315.2–315.7

(56) References Cited

U.S. PATENT DOCUMENTS

| | | | | |
|---|---|---|---|---|
| 2,047,079 | * | 7/1936 | MacMurray | 206/315.6 X |
| 2,502,627 | * | 4/1950 | Martin | 206/315.6 |
| 2,551,780 | * | 5/1951 | Wood | 206/315.3 |
| 3,779,297 | * | 12/1973 | Stammer | 206/315.6 |
| 4,655,346 | * | 4/1987 | Reinholz | 206/315.6 |
| 5,103,974 | * | 4/1992 | Antonious | 206/315.3 X |
| 5,415,284 | * | 5/1995 | King | 206/315.6 X |
| 5,469,960 | * | 11/1995 | Yuill | 206/315.3 |
| 5,868,247 | * | 2/1999 | Schrader | 206/315.6 X |
| 6,021,895 | * | 2/2000 | Wu | 206/315.6 |

FOREIGN PATENT DOCUMENTS

| | | | | |
|---|---|---|---|---|
| 9204 | * | 7/1933 | (AU) | 206/315.4 |
| 25415 | * | 10/1898 | (GB) | 206/316.6 |
| 355836 | * | 9/1931 | (GB) | 206/315.6 |
| 758845 | * | 10/1956 | (GB) | 206/315.6 |
| 214555 | * | 8/1967 | (SE) | 206/315.5 |

* cited by examiner

*Primary Examiner*—Sue A. Weaver
(74) *Attorney, Agent, or Firm*—Chapman and Cutler

(57) ABSTRACT

A golf bag has top holder units for holding golf clubs and protecting them from damage from one another, particular club heads impacting or chafing on shafts of adjacent clubs. The holder units are separable in the top of the bag, by pivoting about lower ends either in the middle of the length of the bag, in one form, or at the bottom of the bag in another form. In the shorter form of the holder units, separation of the units is controlled by pivoting links among the holder units and a handle moveable vertically. In one form the units are separated when the handle is raised, and in another when the handle is lowered. In one sub-form the top holder assembly is provided with guard plates located between pairs of the holder units, each plate having a notch for holding a club head against movement and contact with other clubs. In the long form of holder units, the units are separated from the bottom at a support end. Lateral sides of the bottom are tapered downwardly from the outside, so that when a constraining link at the top of the bag is released the holder units open and separate at the top, pivoting about the base. Separation is controlled in this form by restraining straps extending among the holder units at their tops, in one form.

13 Claims, 5 Drawing Sheets

GOLF BAG WITH CLUB SEPARATORS

BACKGROUND OF THE INVENTION

1. Field of the Invention

The present invention relates, to golf bags and, more particularly, to holder units at the top of the golf bag that are laterally expandable or separable for preventing the clubs from being damaged.

2. Description of the Prior Art

As is well known to those skilled in the art, convention golf bags have structures only for carrying golf clubs, golf balls, and golf accessories, but do not for prevent golf clubs from being damaged by external impact or by rubbing or other contact among the golf clubs.

Since golf clubs are considered to be luxury items, prevention of damage to them is important.

According to recent research results, damage to golf clubs most often results not from contact or collision with an external objects, but results from contact between golf clubs themselves. When a golf club is inserted into or and removed from a golf bag, the shaft of the inserted golf club frequently comes into contact with the head of another golf club in the bag. In addition, the head of a shorter golf club frequently contacts the shaft of a longer golf club during carrying and movement of the golf bag. These contacts cause the shafts of the clubs to be damaged.

As shown by the dotted lines in FIG. 11, when a golf bag with multiple golf clubs is carried or moved, the shafts of longer golf clubs are situated within the swing range of the heads of golf clubs having shorter shafts. Therefore, damage to the club shafts occurs while the golf bag is being carried and moved and when a golf club is being inserted into or removed from the bag.

To overcome such problems by providing spaces between the golf clubs, at least 14 inches in width is required to arrange three golf clubs in a line, as depicted in FIG. 12. However, since currently used golf bags are less than 10 inches across, the above-mentioned problems are not solved in this manner.

Incidentally, Club head covers have been used to eliminate such problems and to protect golf clubs from damage. Nevertheless, in the use of such a club head cover, it is troublesome to put the cover on the head of a golf club and to take the cover off the head of the golf club. Additionally, damage may occur to the shaft of a club inserted into a golf bag because adjacent golf clubs in the golf bag have to be lifted up or otherwise adjusted to allow space when a golf club is inserted into the golf bag.

SUMMARY OF THE INVENTION

An object of the present invention is to provide a golf bag with holder units in the golf bag that are separable, for preventing golf clubs from being damaged.

The present invention provides a golf bag having a golf bag body open at its top and a lower support mounted to the lower end of the golf bag body. The bag comprises two or more divided holder units, the holder units being arranged and mounted to be separable and retractable in a lateral direction at the top end of the bag. In one form, guard plates are extended longitudinally to hold and separate the club heads.

DESCRIPTION OF THE PREFERRED EMBODIMENTS

In FIGS. 1–4, a golf bag A1 according to the first embodiment A1 invention is illustrated. In this embodiment, the golf bag A1 is provided with holder units 2 in the bag body 9. The holder units 2 extending from a top, open end T, to a middle portion M of the bag body 9. Although the number of the holder units 2 is four in this embodiment, the number of club holder units 2 may be two, three, five or more. Each of the holder units 2 has four compartments 3, thereby having sixteen compartments 3 in total in the bag. The compartments 3 are divided by lateral partitions 2*a*. The number of compartments 3 is not limited to sixteen, but is variable. Although each of the holder units extends from the top end T of the bag body 9 to the middle portion M of the bag body 9 in this embodiment, each of the holder units 2 may be longer or shorter than that of this embodiment. The upper portions of each of the holder units 2 are separated, but the lower portions are not. The spacing between the holder units 2, obtained when the holder units 2 are separated, is regulated by varying the length of the controlling links 6.

Figure 3:
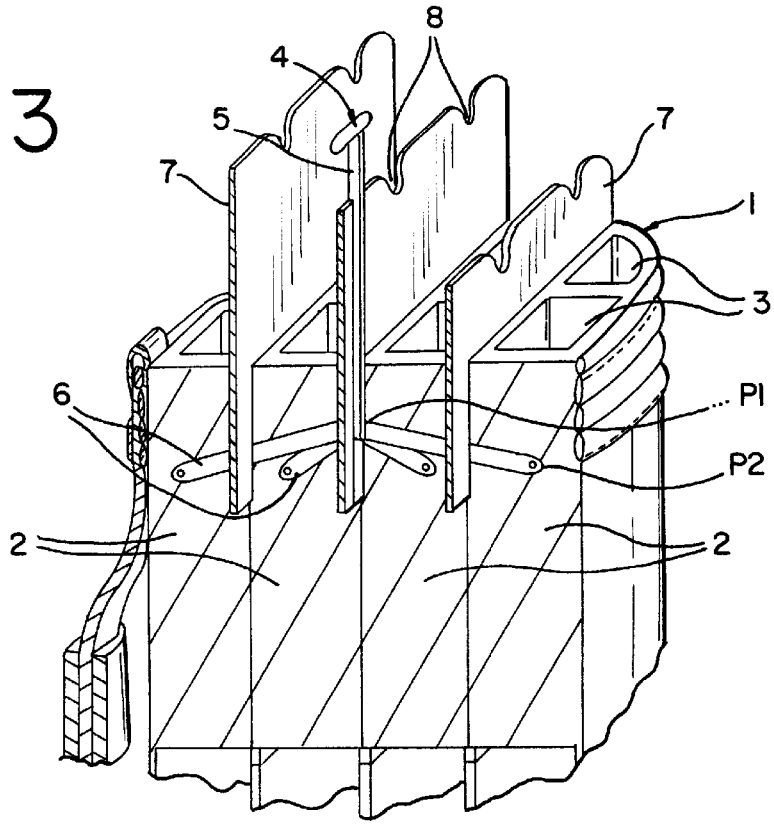
FIG. 3 is a longitudinally sectioned perspective view, showing the upper portion of the golf bag of FIG. 1 with guard plates extended and holder units retracted.
Figure 4:
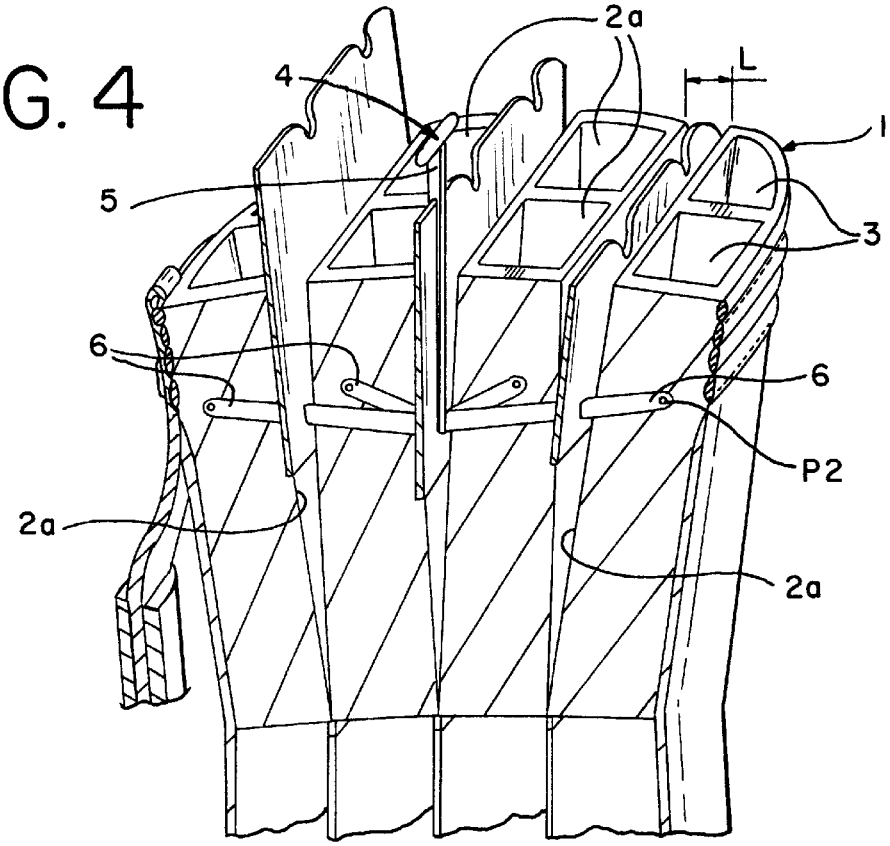
FIG. 4 is a longitudinally sectioned perspective view, showing the upper portion of the golf bag of FIG. 1 with guard plates retracted and holder units separated.

A link type moving device as shown in FIGS. 3 and 4 is mounted to upper portions of the holder units 2, thus connecting the holder units 2 together. The link type moving device consists of a grip 4, a vertical connecting rod 5 and multiple links 6, the device forcing the holder units 2 to be separated or retracted. In this embodiment, a common moving pin P1 in the links 6 is located above fixed pins P2 in the links 6 in the retracted position. Consequently, when the moving hinge P1 is moved downward, the holder units 21 are separated, or extended apart. At this time, three guard plates 7 are inserted into the spaces between the holder units 2. The guard plates 7 are connected to the links 6, thereby moving up and down together with the link type moving device. Further, each of the guard plates 7 is formed with club holding grooves 8 for holding a golf club within each groove 8 when retracted.

Figure 2:
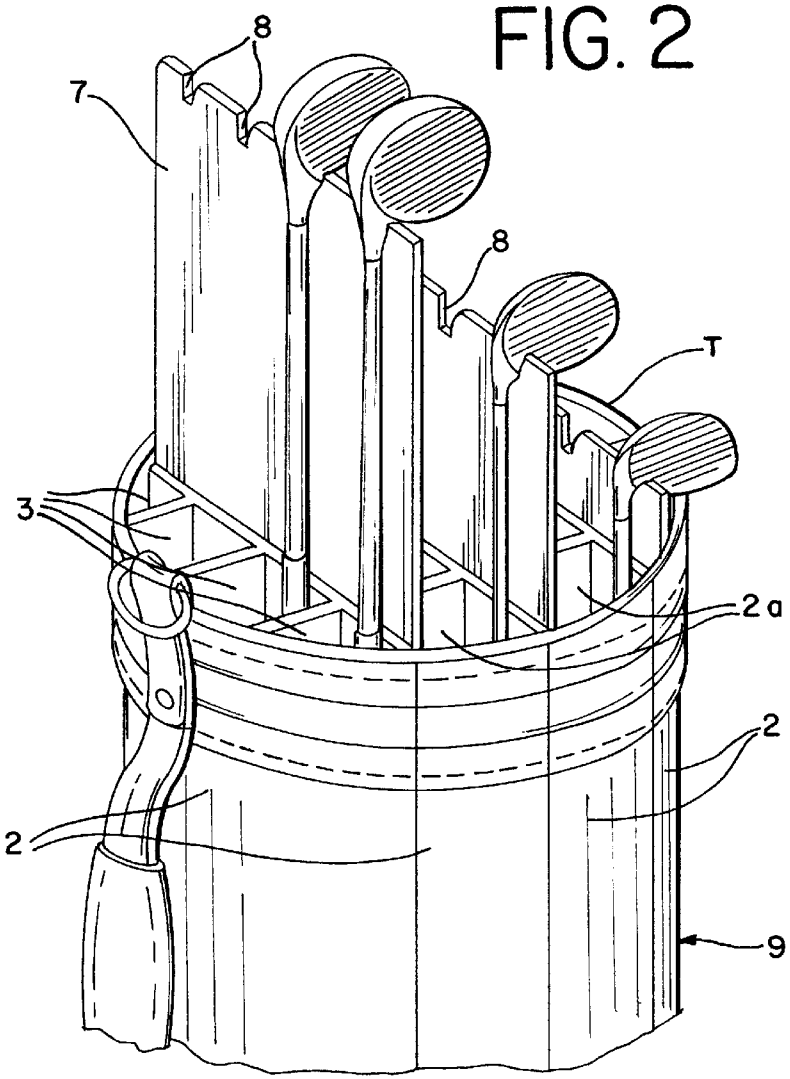
FIG. 2 is a perspective view, of the upper portion of the golf bag of FIG. 1.
Figure 1:
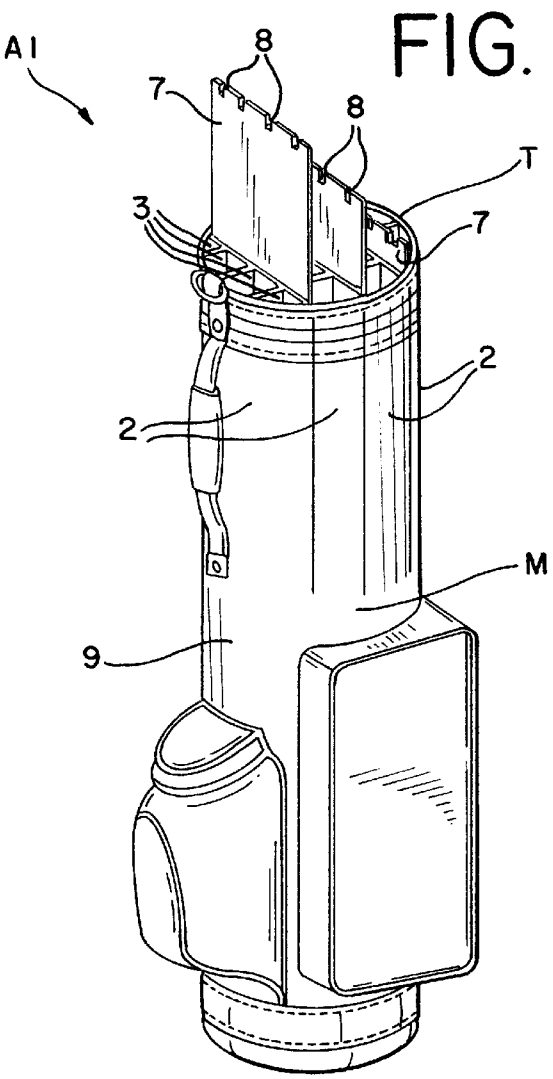
FIG. 1 is a perspective view, of a golf bag according to a first embodiment of the invention.

As shown in FIGS. 1 and 2, in accordance with the golf bag of this embodiment, when golf clubs are stored in the golf bag, the vertical connecting rod 5 and the guard plates 7 are raised up, thus holding the golf club heads within the groove 8 of the plates 7. On the other hand, when a golf club is to be inserted into or removed from the golf bag A1, the vertical connecting rod 5 has to be pushed down. As the vertical connecting rod 5 is pushed down, the guard plates 7 descend down and, simultaneously, the pin P1 coupled to the upper end of each of the links 6 descends down, thereby widening the spaces between the holder units 2.

When spaces between the holder units 2 are widened as shown in FIG. 4, the added spacing L between golf clubs allows a golf club to be inserted into or removed from the golf bag Al without interference with the other golf clubs. Additionally, when the holder units 2 are spaced apart, the guard plates 7, together with the links 6, function to maintain the spaces between the holder units 2.

After a golf club is inserted into or removed from the golf bag A1, the vertical connecting rod 5 is pulled up. As the vertical connecting rod 5 is pulled up, the guard plates 7 ascends and, simultaneously, the pin P1 coupled to the upper end of each of the links 6 ascends thereby narrowing the spaces between the holder units 2. As a result, the holder units 2 retract and the guard plates 5 ascend, and golf clubs are held by the guard plates 5 within the club holding grooves 8 for storage in the golf bag A1.

Figure 5:
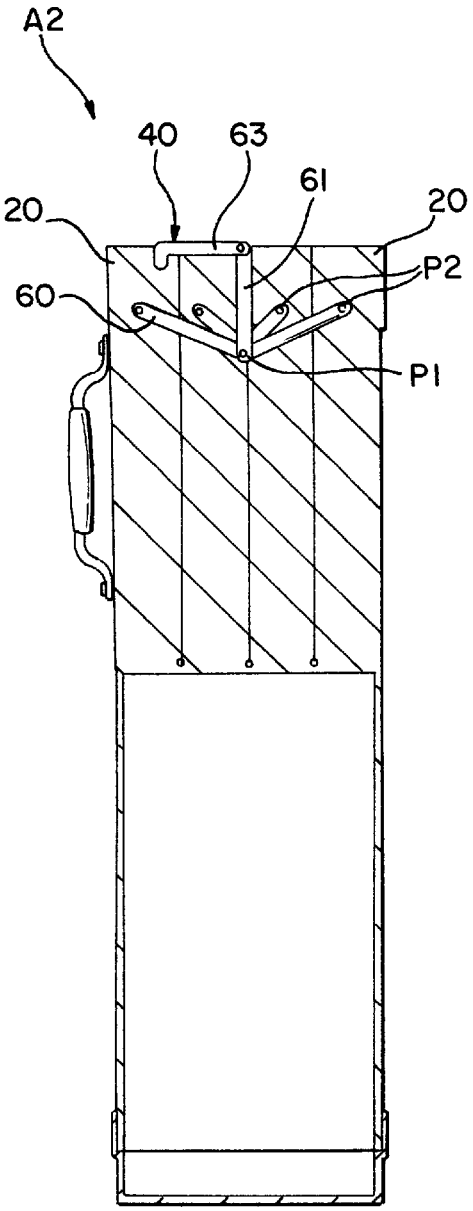
FIG. 5 is a longitudinally sectioned view of a golf bag according to a second embodiment of the invention, with the holder units separated.
Figure 6:
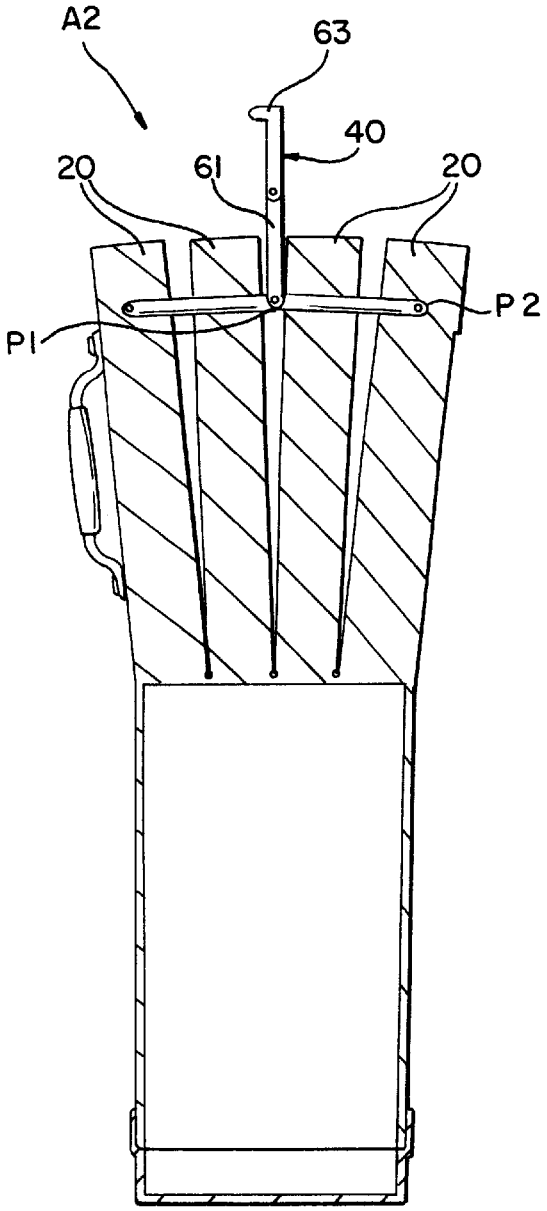
FIG. 6 is a longitudinally sectioned view like FIG. 5 with the holders units separated.

In FIGS. 5 and 6, a golf bag A2 according to the second embodiment of this invention is illustrated. A link type moving device 40 is mounted to the upper portions of holder units 20, thus connecting the holder units 20 together. The link type moving device 40 consists of four driven links 60 individually connected to one of the holder units 20 at one end, a vertical drive link 61 connected at one end to the other ends of the driven links 60, and a locking hook 63 connected at one end to the other end of the vertical drive link 61.

In this embodiment, a common moving pin P1 of the links 60 is located below fixed pins P2 of the links 60 in the retracted position contrary to the first embodiment. Consequently, when the pin P1 is moved upwardly, the holder units 20 are separated or extended apart. That is, when the locking hook 63 is unlocked and the vertical drive link 61 is raised, the moving pin P1 coupled to the upper end of each of the links 60 rises, thereby widening spaces between the holder units 20. When spaces between the holder units 20 are widened as shown in FIG. 6, the added spacing between the holder units allows a golf club to be inserted into or removed from the golf bag A2 without interference with the other golf clubs. After the golf club is inserted into or removed from the golf bag A2, the vertical connecting rod 61 may be pushed down, thus returning the holder units 20 back to the retracted position of FIG. 5.

Figure 7:
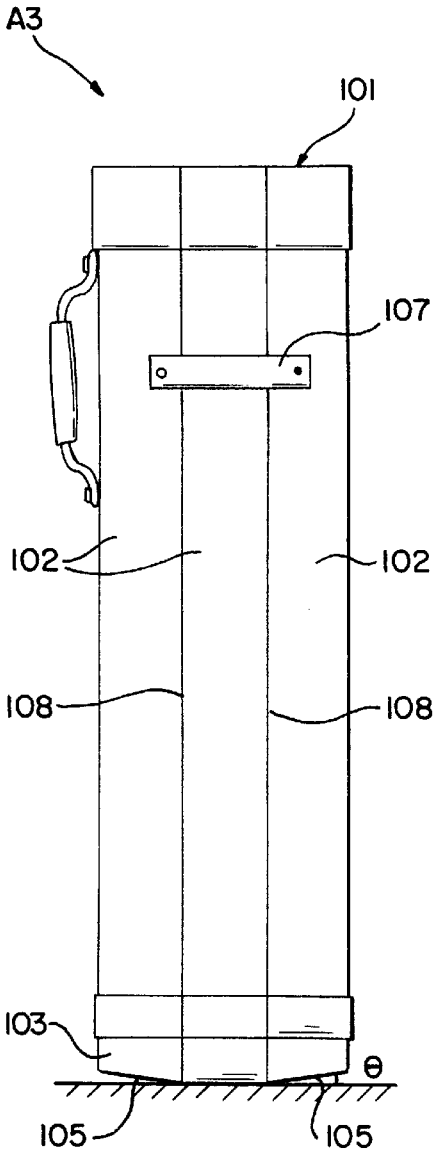
FIG. 7 is a front view of a golf bag according to a third embodiment of this invention, with holder units retracted.
Figure 8:
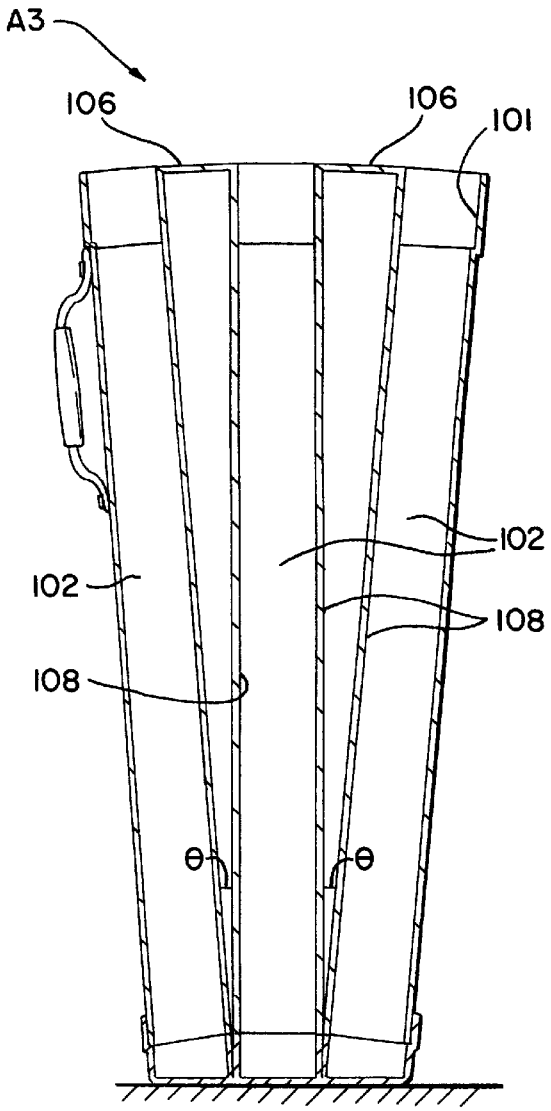
FIG. 8 is a front like FIG. 7 with the holder units separated.
Figure 9A:
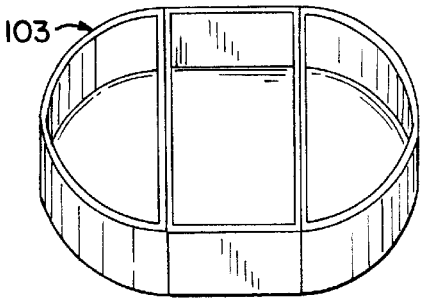
FIG. 9*a* is a perspective view of a support in a normal state according to the third embodiment.
Figure 9B:
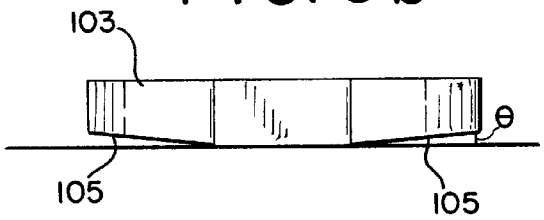
FIG. 9*b* is a front view of FIG. 9*a;*
Figure 10A:
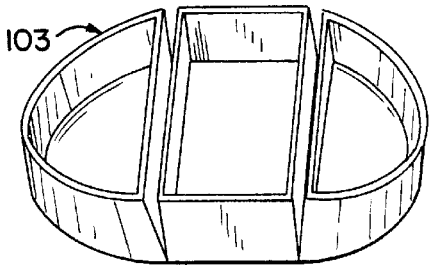
FIG. 10*a* is a perspective view of a support in a separated state according to the third embodiment of the invention.
Figure 10B:
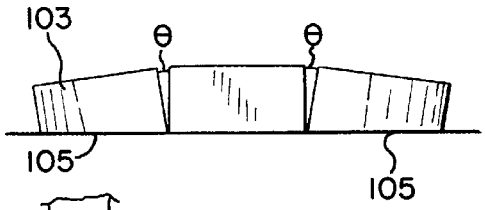
FIG. 10*b* is a front view of FIG. 10*a;*
Figure 11:
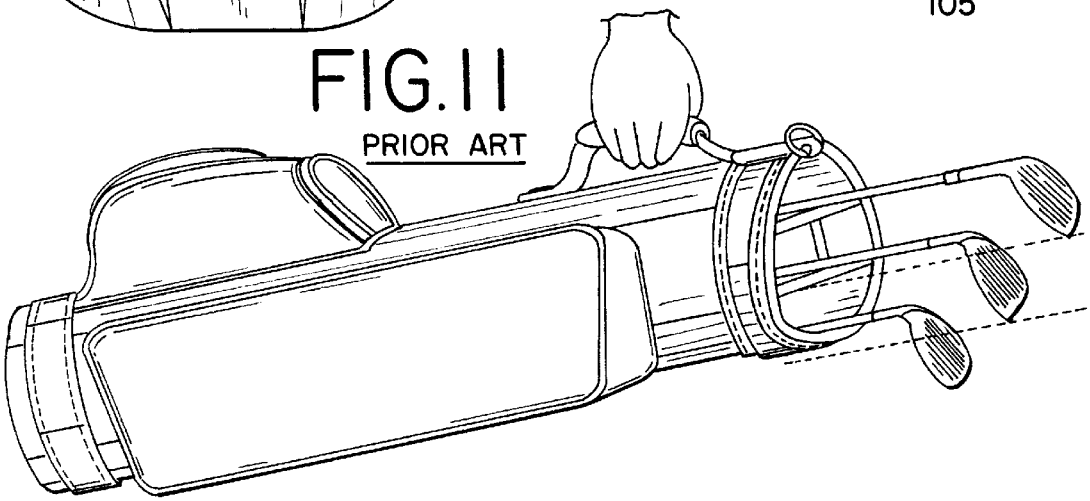
FIG. 11 PRIOR ART
FIG. 11 is a perspective view of an arrangement of golf clubs in a conventional golf bag during carrying.
Figure 12:
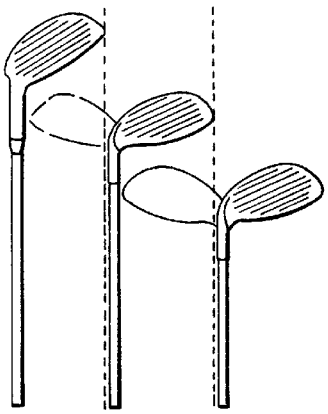
FIG. 12 is a diagram of a typical arrangement of golf clubs in a conventional golf bag.
Figure 13:
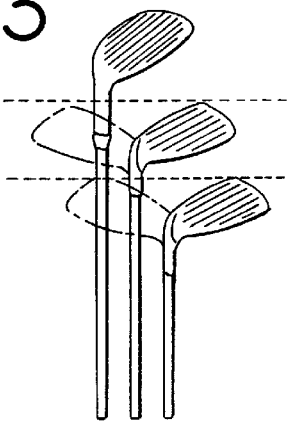
FIG. 13 PRIOR ART
FIG. 13 is a diagram of a desired arrangement of golf clubs in a golf bag in which the club heads do not contact adjacent club shafts.

FIGS. 7 and 8 show a golf bag A3 according to the third embodiment. The golf bag A3 comprises three holder units 102 extending from a top surface 101 to a lower support 103. Side walls 108 of three holder units 102 extend from the top 101 of the golf bag A3 to the lower support 103. The holder units 102 are connected together by two restrainer 106 limit the maximum spacing between the holder units 102 when separated. The lower support 103 has three parts arranged side by side, two outside parts 105, 105 of the support 103 being upwardly tapered from the centers at an angle of θ from the horizonal. The holder units 102 are separated or retracted by means of the lower support 103 and restrainers 106. A locking strip 107 is provided on a surface of the golf bag A3 to lock the golf bag A3 in the retracted state. Therefore, the holder units 102 are separated by pivoting on the lower support 103, with the spacing between the holder units 102 limited by the restrainer 106. The retracted normal state of the golf bag A3 is maintained by means of the locking strip 107. The maximum spacing between the holder units 102 is preferably 5–50 mm.

When the locking strip 107 is locked and golf clubs are kept in the golf bag A3 as shown in FIG. 7, the golf bag A3 is stood uprightly and the locking strip 107 is unlocked to expand the golf bag A3. Since the holder units 102 have weight and two outside parts of the support 103 are inwardly tapered, the holder units are separated spontaneously at their tops. The holder units 102 are separated to the extent of angle θ and the extent of the separation at the top of the bag is limited by the restrainer 106. When the holder units 102 are separated a golf club can easily be inserted into or removed from the golf bag A3 without interference with the other golf clubs. After the golf club is inserted into or removed from the golf bag A3, the holder units 102. The retracted golf bag A3 is reduced in volume, thereby being easy to be stored and carried.

In the third embodiment, each restrainer 106 is made of a textile fabric, but it may be an elastic band, thus making easier the return of the holder units 102 to the retracted state.

Although the preferred embodiments of the present invention have been disclosed for illustrative purposes, those skilled in the art will appreciate that various modifications, additions and substitutions are possible, without departing from the scope and spirit of the invention as defined in the accompanying claims.

What is claimed is:

1. A golf bag having an open upper end and a closed lower end, and laterally spaced back and front sides, for receiving golf clubs therein for carrying, storage, and access to the clubs for play, the open upper end having a top that is generally flat when the bag is carried and stored, the bag comprising a plurality of club holder units at the flat upper end thereof, each divided sidewardly into compartments for holding and for protecting the clubs therein against chafing on and scratching one another, and wherein the holder units are separable laterally, front to back in the bag, for facilitating easier access to the clubs than is available when the holder units are not separated.

2. A golf bag as defined in claim 1, wherein the holder units extend the length of the golf bag and are separable laterally from one another by pivoting near their bottoms.

3. A golf bag as defined in claim 2, wherein the separation and retraction of the holder units are controlled by a locking bar that is pivoted on one, outer holder unit and slideably attached to an opposite, outer holding unit, for releasing the units in one position to separate and for retaining the units in a retracted position when moved to another position.

4. A golf bag as defined in claim 2, further comprising extension-limiting straps affixed between the holder units at their tops, for holding the units at their separated positions.

5. A golf bag as defined in claim 1, wherein the holder units are spaced apart in the separated position by from about five to about 50 millimeters.

6. A golf bag having an open upper end and a closed lower end, and laterally spaced back and front sides, for receiving golf clubs therein for carrying, storage, and access to the clubs for play, the bag comprising a plurality of club holder units at the upper end thereof, each divided sidewardly into compartments for holding and for protecting the clubs therein against chafing on and scratching one another, and wherein the holder units are separable laterally, front to back in the bag, for facilitating access to the clubs, the holder units extend only partway down the length of the golf bag, the holder units further comprise a handle and a plurality of moveable, elongated links controlled by the handle, each of said links pivotably joined at a first end thereof to one of the holder units and to the handle at the second end thereof, and the handle controlling the lateral separation and retraction of the holder units by its vertical position with respect to the holder units, through its movement of the links.

7. A golf bag as defined in claim 6, wherein the pivotal joining of the handle to the second ends of the links is located higher than the points of pivotal joining of first ends of the links to the holder units when the holder units are separated, and retraction of the holder units occurs upon downward movement of the handle with respect to the holder units.

8. A golf bag as defined in claim 7, further comprising guard plates interposed between adjacent ones of the holder units, each said plate having a notch in an upper edge thereof near the center of each compartment in an adjacent one of the holder units for receiving therein the head of a golf club.

9. A golf bag as defined in claim 6, further comprising an elongated locking link having opposed ends, one of the ends being pivoted to the handle at an upper end thereof and the other end of the locking link being removably engageable with a top of a holder unit when the handle is pushed downwardly to retract the holder units.

10. A golf bag as defined in claim 6, further comprising guard plates interposed between adjacent ones of the holder units, each said plate having a notch in an upper edge thereof near the center of each compartment in an adjacent one of the holder units for receiving therein the head of a golf club.

11. A golf bag as defined in claim 10, wherein the guard plates are connected to move with the pivoting links.

12. A golf bag as defined in claim 6, wherein the pivotal joining of the handle to the second ends of the links is located lower than the points of pivotal joining of first ends of the links to the holder units when the holder units are separated, and retraction of the holder units occurs upon upward movement of the handle with respect to the holder units.

13. A golf bag having an open upper end and a closed lower end, and laterally spaced back and front sides, for receiving golf clubs therein for carrying, storage, and access to the clubs for play, the bag comprising a plurality of club holder units at the upper end thereof, each divided sidewardly into compartments for holding and for protecting the clubs therein against chafing on and scratching one another, and wherein the holder units are separable laterally, front to back in the bag, for facilitating access to the clubs, the holder units extend the length of the golf bag and are separable laterally from one another by pivoting near their bottoms, and wherein the closed lower end includes a support for the bag, the support being divided to coincide with the holder units, and outer parts of the support being tapered at their bottoms so as to lay flat on a horizontal surface when the holder units are separated to their full extents.

* * * * *